US008418445B2

(12) United States Patent
Laube et al.

(10) Patent No.: US 8,418,445 B2
(45) Date of Patent: Apr. 16, 2013

(54) EXHAUST SYSTEM FOR AN INTERNAL COMBUSTION ENGINE

(75) Inventors: Thomas Laube, Leonberg (DE); Bernd Müller, Wiernsheim (DE); Michael Wessels, Bietigheim-Bissingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 257 days.

(21) Appl. No.: 12/829,488

(22) Filed: Jul. 2, 2010

(65) Prior Publication Data

US 2011/0000186 A1 Jan. 6, 2011

(30) Foreign Application Priority Data

Jul. 6, 2009 (DE) ..... 10 2009 032 214

(51) Int. Cl.

| | |
|---|---|
| ***F01N 1/00*** | (2006.01) |
| ***F01N 3/00*** | (2006.01) |
| ***F01N 3/02*** | (2006.01) |
| ***F01N 13/00*** | (2010.01) |
| ***F02B 27/02*** | (2006.01) |

(52) U.S. Cl.
USPC ..... 60/299; 60/287; 60/324; 60/288; 60/297; 60/311; 60/312; 60/314; 60/313; 181/253; 181/254; 181/238

(58) Field of Classification Search ..... 60/299, 60/324, 288, 297, 311–314, 287; 181/212, 181/250, 228, 239, 254, 253, 238; 29/890.08, 29/890.052
See application file for complete search history.

(56) References Cited

U.S. PATENT DOCUMENTS

| | | | | |
|---|---|---|---|---|
| 5,325,666 | A * | 7/1994 | Rutschmann | 60/302 |
| 6,938,729 | B2 * | 9/2005 | Worner et al. | 181/254 |
| 6,964,161 | B2 * | 11/2005 | Campbell | 60/308 |
| 7,490,465 | B2 | 2/2009 | Weimert et al. | |
| 7,562,741 | B2 | 7/2009 | Winklel et al. | |
| 7,686,130 | B1 * | 3/2010 | Quaglia | 181/226 |
| 7,703,574 | B2 | 4/2010 | Krüger et al. | |
| 2008/0110155 | A1 * | 5/2008 | Harada | 60/276 |

FOREIGN PATENT DOCUMENTS

| | | |
|---|---|---|
| DE | 94 06 200.5 | 7/1994 |
| DE | 102 44 021 A1 | 4/2004 |
| DE | 10 2007 026 812 A1 | 12/2008 |

(Continued)

OTHER PUBLICATIONS

German Search Report, Feb. 9, 2010.

*Primary Examiner* — Thomas E. Denion
*Assistant Examiner* — Anthony Ayala Delgado
(74) *Attorney, Agent, or Firm* — RatnerPrestia

(57) ABSTRACT

An exhaust system for an internal combustion engine, having a first exhaust tract assigned to a first group of cylinders of the internal combustion engine, and having a second exhaust tract assigned to a second group of cylinders of the internal combustion engine, each exhaust tract comprising an exhaust gas purification device, a first silencer arranged on the outlet side of the respective exhaust gas purification device, and a second silencer arranged on the outlet side of the respective first silencer. Each exhaust tract includes a bypass line, it being possible for exhaust gas to be diverted via each bypass line, starting from the respective first silencer, bypassing the second silencers, and the bypass lines and hence the first silencers of both exhaust tracts being connected to one another by a mixing line.

13 Claims, 2 Drawing Sheets

FOREIGN PATENT DOCUMENTS

| | | | | |
|---|---|---|---|---|
| EP | 1798390 | A2 | * | 6/2007 |
| EP | 1 914 398 | A1 | | 4/2008 |
| JP | 2-207121 | | | 8/1990 |
| JP | 200554736 | A | * | 3/2005 |
| JP | 2006 283 644 | A | | 10/2006 |
| WO | WO 2005/113956 | A1 | | 12/2005 |

* cited by examiner

EXHAUST SYSTEM FOR AN INTERNAL COMBUSTION ENGINE

CROSS REFERENCE TO RELATED APPLICATIONS

This U.S. patent application claims priority to German Patent Application DE 10 2009 032 214.0, filed Jul. 6, 2009, which is incorporated by reference herein in its entirety.

FIELD OF THE INVENTION

The invention relates to an exhaust system for an internal combustion engine.

BACKGROUND OF THE INVENTION

DE 102 44 021 A1 and DE 10 2007 026 812 A1 have each disclosed exhaust systems for an internal combustion engine in which a first group of cylinders of the internal combustion engine is assigned a first exhaust tract of the exhaust system, and a second group of cylinders of the internal combustion engine is assigned a second exhaust tract of the exhaust system.

According to DE 102 44 021 A1, each exhaust tract of the exhaust system comprises an exhaust gas purification device, namely a catalytic converter, and two silencers arranged on the outlet side of the exhaust gas purification device, namely a first silencer arranged on the outlet side of the respective exhaust gas purification device and a second silencer arranged on the outlet side of the respective first silencer. The two exhaust tracts of the exhaust system are connected to one another by a sound transmission device, the sound transmission device engaging on the exhaust tracts downstream of the exhaust gas purification devices and upstream of the first silencers, as seen in the direction of flow of the exhaust gas, and interconnecting them, more specifically in accordance with the position of a flap assigned to the sound transmission device.

According to DE 10 2007 026 812 A1, there are two sound transmission devices, via which the exhaust tracts are coupled to one another.

SUMMARY OF THE INVENTION

Taking this as a starting point, it is an object of the invention presented here to provide a novel exhaust system for an internal combustion engine.

According to aspects of the invention, each exhaust tract comprises a bypass line, it being possible for exhaust gas to be diverted via each bypass line, starting from the respective first silencer, preferably bypassing the second silencers, and the bypass lines and hence the first silencers of both exhaust tracts being connected to one another by a mixing line.

With the exhaust system according to aspects of the invention, the internal combustion engine of a motor vehicle can be operated with a high degree of efficiency and low noise emissions. In the exhaust system according to aspects of the invention, the bypass lines and the first silencers are connected by a mixing line, thereby making it possible, with little outlay, to optimize a charge cycle of the internal combustion engine to which an exhaust system of this kind is assigned, and hence to optimize the efficiency of the internal combustion engine.

The exhaust system according to aspects of the invention makes it possible, with two switching elements, to bypass a silencer and at the same time to achieve a crosstalk effect between the two exhaust tracts.

BRIEF DESCRIPTION OF THE DRAWINGS

Preferred developments of the invention will emerge from the following description. Illustrative embodiments of the invention are explained in greater detail with reference to the drawing, without being limited thereto. In the drawing.

DETAILED DESCRIPTION OF THE PREFERRED EMBODIMENTS

The invention presented here relates to an exhaust system for an internal combustion engine.

Figure 1:
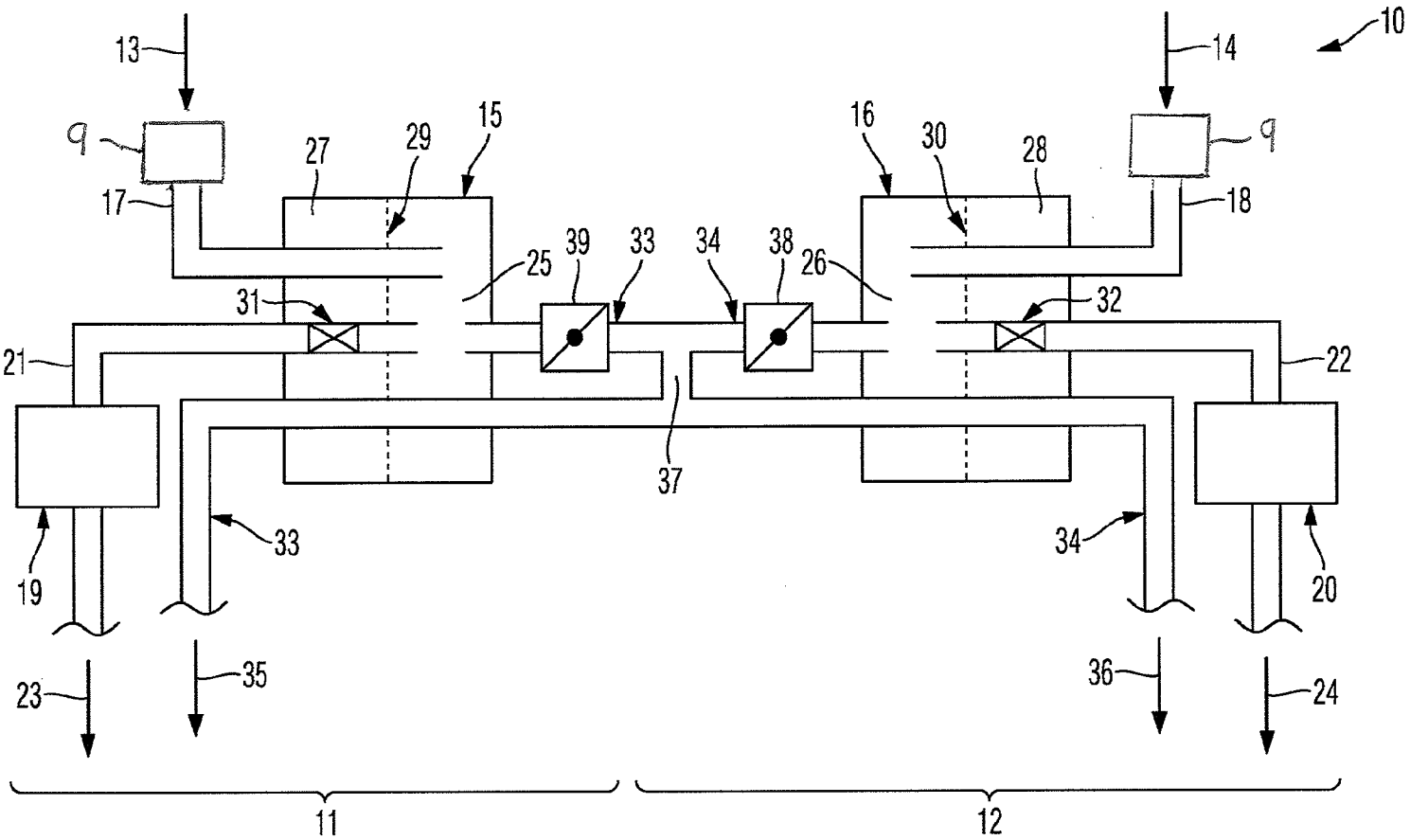
FIG. 1 shows a schematized representation of a first illustrative embodiment of an exhaust system according to aspects of the invention.

FIG. 1 shows a schematized representation of a first illustrative embodiment of an exhaust system 10 according to aspects of the invention for an internal combustion engine, the exhaust system shown in FIG. 1 comprising two exhaust tracts 11 and 12. Each exhaust tract 11 and 12 is assigned to a group of cylinders of an internal combustion engine (not shown), namely the first exhaust tract 11 to a first group of cylinders of the internal combustion engine and the second exhaust tract 12 to a second group of cylinders of the internal combustion engine.

Each exhaust tract 11 and 12 has an exhaust gas purification system 9 (not shown in FIG. 1), each of which is formed by at least one catalytic converter. Starting from the exhaust gas purification systems 9 of the exhaust tracts 11 and 12, purified exhaust gas can be fed in the direction of arrows 13 and 14 to a first silencer 15 or 16 of the respective exhaust tract 11 or 12, namely in each case via an inlet line 17 or 18 extending between the respective exhaust gas purification system 9 and the respective first silencer 15 or 16 of the respective exhaust tract 11 or 12.

Each of the two exhaust tracts 11 and 12 of the exhaust system 10 according to aspects of the invention, which is shown in FIG. 1, has a second silencer 19, 20 in addition to the respective first silencer 15, 16, the second silencers 19, 20 of the respective exhaust tracts 11, 12 being arranged on the outlet side of the respective first silencer 15, 16 in such a way that exhaust gas can be fed to the respective second silencer 19 or 20 via an outlet line 21 or 22 of the respective first silencer 15 or 16, said outlet line extending between the respective first silencer 15 or 16 and the respective second silencer 19 or 20. Exhaust gas which flows through the respective second silencers 19 and 20 of the two exhaust tracts 11 and 12 can be diverted outwards to the environment in the direction of arrows 23 and 24 respectively.

In the illustrative embodiment shown in FIG. 1, each of the two first silencers 15, 16 of the two exhaust tracts 11, 12 has two chambers, namely a first chamber 25 or 26 and a second chamber 27 or 28, the two chambers 25 and 27; 26 and 28 of the first silencers 15 and 16 respectively being connected to one another by a perforated dividing wall 29 or 30. However, the provision of more than two chambers is conceivable. Both chambers 25 and 27; 26 and 28 can be dimensioned to be of equal size or of different sizes. According to FIG. 1, the inlet lines 17 and 18 and the outlet lines 21 and 22 of the first silencers 15 and 16 of the two exhaust tracts 11 and 12 each open into the first chambers 25 and 26 of the respective first silencers 15 and 16.

As can furthermore be seen from FIG. 1, the inlet lines 17 and 18 and outlet lines 21 and 22 of the respective first silencers 15 and 16 extend through the second chambers 27 and 28 of the respective first silencer 15 and 16, and, in the illustrative embodiment shown in FIG. 1, the outlet lines 21 and 22 of the first silencers 15 and 16 are perforated in a section 31 and 32, respectively, which extends in the respective second chamber 27 or 28. Similarly, the inlet lines 17 and 18 of the first silencers 15 and 16 can also be perforated.

Each exhaust tract 11 and 12 of the exhaust system 10 according to aspects of the invention furthermore has a bypass line 33 and 34 respectively in addition to the subassemblies already mentioned above.

Via the bypass lines 33 and 34, exhaust gas can be diverted outwards, starting from the respective first silencer 15 or 16, to the environment in the direction of arrows 35 and 36, bypassing the second silencers 19, 20, and, in accordance with FIG. 1, the bypass lines 33 and 34 each open in the region of the respective first silencer 15, 16 into the first chamber 25 or 26 thereof, into which the inlet lines 15, 18 and the outlet lines 21, 22 of the respective exhaust tract 11, 12 also open.

The bypass lines 33 and 34 and hence the first silencers 15, 16 of the two exhaust tracts 11 and 12 are connected or coupled to one another by a mixing line 37. It should be noted that the sections of the bypass lines 33 and 34 which open into the chambers 25, 26 of the first silencers 15, 16 can also be counted as part of the mixing line 37. These sections participate both in the bypass function for the second silencers 19, 20 and in the connecting function for the first silencers 15, 16.

In the illustrative embodiment in FIG. 1, each of the two bypass lines 33 and 34, namely a section thereof which can also be counted as part of the mixing line 37, is assigned a shut-off device 38 and 39, respectively, downstream of the respective first silencer 15 or 16 and upstream of the actual mixing line 37, as seen in the direction of flow of the exhaust gas, by means of which shut-off device the respective bypass line 33 or 34 can be opened and closed.

The bypass lines 33 and 34 can be either opened or closed uniformly or opened or closed differently by means of the shut-off devices 38 and 39 assigned thereto.

As can be seen from FIG. 1, the bypass lines 33 and 34 are each routed through the first silencers 15 and 16, namely via both chambers 25 and 27; 26 and 28 thereof, downstream of the actual mixing line 37, as seen in the direction of flow of the exhaust gas. This makes it possible to achieve a longer length for the bypass lines 34 and 35, thereby making it possible to reduce to a minimum an unwanted droning of the exhaust system 10 at low rotational speeds of the internal combustion engine.

In order to reduce any stresses occurring at the mixing line 37 owing to excitation of operational vibration, connecting elements, such as connecting plates, can be provided between the first silencers 15 and 16 of both exhaust tracts 11 and 12.

The exhaust system 10 shown in FIG. 1 can be operated differently in different rotational speed ranges and load ranges of the internal combustion engine. The following four operating modes are particularly preferred:

In a first operating mode of the exhaust system 10 shown in FIG. 1, both shut-off devices 38 and 39 are open, when, for example, sporty noise behavior is desired at a low load and low rotational speed of the internal combustion engine. Since the two first silencers 15 and 16 are connected to one another and the second silencers 19 and 20 are furthermore bypassed via the bypass lines 33 and 34 when both shut-off devices 38 and 39 are open, a sporty sound or sporty acoustic impression can be ensured at a low load and low rotational speed of the internal combustion engine, giving the driver better feedback on the operating state of the internal combustion engine. Moreover, the coupling or connection of the two first silencers 15 and 16 mitigates an acoustic rise in level brought about by the bypass lines 33 and 34.

In a second operating mode of the exhaust system 10, both shut-off devices 38 and 39 are also opened at a high load and high rotational speed of the internal combustion engine, in which case maximum dethrottling of the stream of exhaust gas can be achieved at a high load and high rotational speed of the internal combustion engine. This has a positive effect on the charge cycle and hence on the efficiency of the internal combustion engine. The stream of exhaust gas from each group of cylinders can then escape or be carried away to the environment simultaneously via four outlet pipes in the direction of arrows 23, 24, 35 and 36.

In a third operating mode of the exhaust system 10, both shut-off devices 38 and 39 are closed. It is thereby possible to achieve a high degree of sound attenuation across all load ranges and rotational speed ranges of the internal combustion engine since the bypass lines 33, 34 are closed and all the exhaust gas is passed via the second silencers 19, 20. At certain rotational speeds, it is accordingly possible to achieve a positive influence on the torque profile with the shut-off devices 38 and 39 open, bringing about a specifically intended torque rise in a particular rotational speed range, depending on the configuration and dimensioning of the bypass lines 33, 34.

In a fourth operating mode of the exhaust system 10, just one of the two shut-off devices 38 or 39 is open, while the other shut-off device 39 or 38 is closed. As a result, a bypass line is opened only for one exhaust tract, but coupling between the exhaust tracts, namely between the first silencers 15 and 16 thereof, is suppressed.

Figure 2:
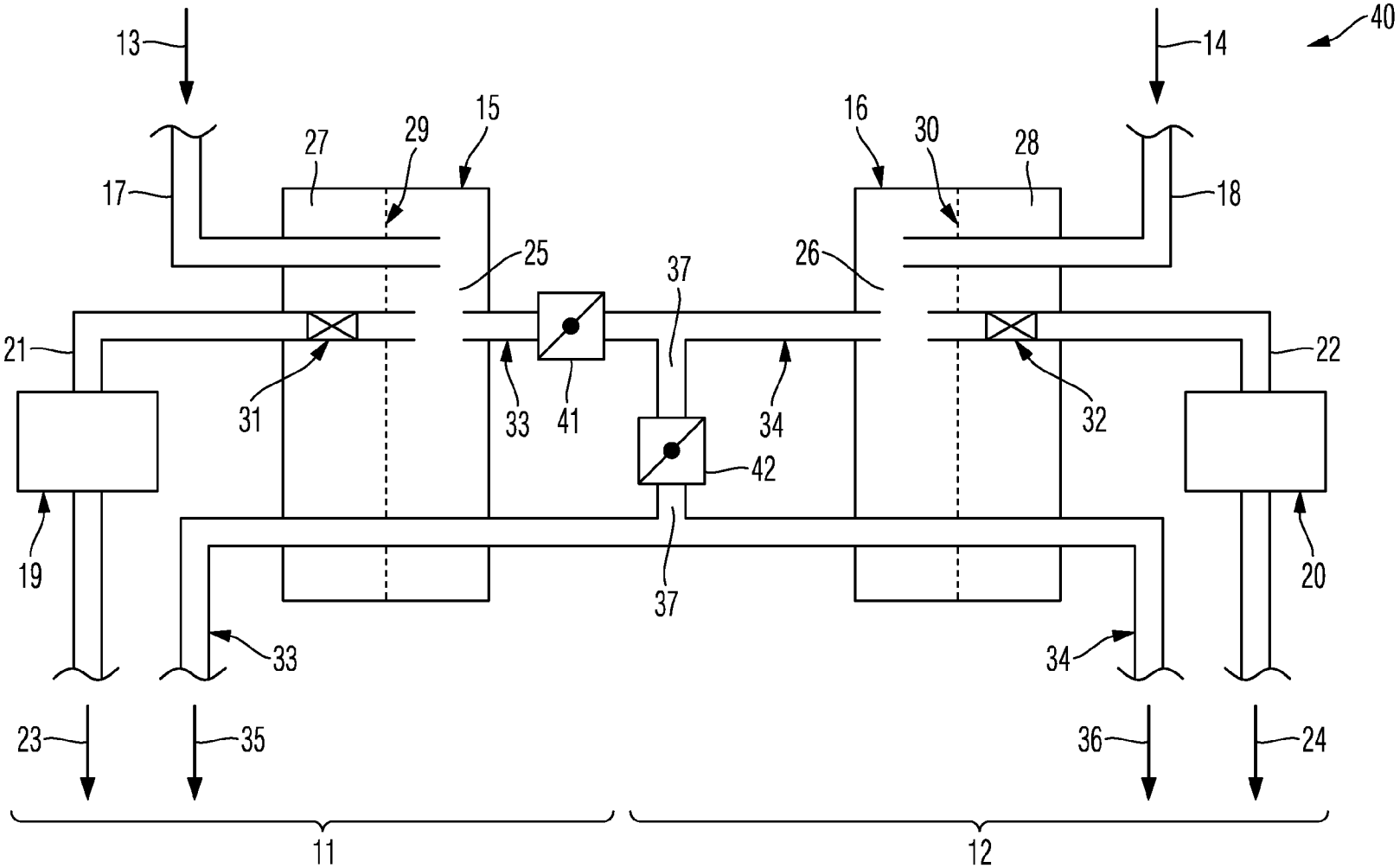
FIG. 2 shows a schematized representation of a second illustrative embodiment of an exhaust system according to aspects of the invention.

A second illustrative embodiment of an exhaust system 40 according to aspects of the invention is shown by FIG. 2, unnecessary repetition being avoided by using identical reference signs to those in the illustrative embodiment in FIG. 1 for identical subassemblies in the illustrative embodiment in FIG. 2 and a detailed explanation being given below only of those details which distinguish the exhaust system 40 in the illustrative embodiment in FIG. 2 from the exhaust system 10 in the illustrative embodiment in FIG. 1.

The illustrative embodiment in FIG. 2 is distinguished from the illustrative embodiment in FIG. 1 in that only the bypass line 33 of exhaust tract 11 is assigned a shut-off device 41 and in that, furthermore, the actual mixing line 37 is assigned a shut-off device 42.

Accordingly, the illustrative embodiment in FIG. 2 is distinguished from the illustrative embodiment in FIG. 1 only in the arrangement of the shut-off devices, with a shut-off device being assigned to only one bypass line and a further shut-off device being assigned to the mixing line in the illustrative embodiment in FIG. 2, while each of the two bypass lines is assigned a shut-off device in the illustrative embodiment in FIG. 1. This results in differences in terms of the operating modes that can be achieved with the exhaust system.

Thus the four exhaust-system operating modes described in connection with the illustrative embodiment in FIG. 1 can also be provided in the illustrative embodiment in FIG. 2, it being possible to achieve the fourth operating mode of the exhaust system 10 shown in FIG. 1 in the exhaust system 40 shown in FIG. 2 by opening the shut-off device 42 assigned to the actual mixing line 37 and closing the shut-off device 41 assigned to the bypass line 33.

In addition to the four operating modes described in connection with the illustrative embodiment in FIG. 1, a further, fifth operating mode can be achieved in the exhaust system 40 in FIG. 2, in which operating mode the shut-off device 41 assigned to the bypass line 33 is open and the shut-off device 42 assigned to the mixing line 37 is closed. In this operating mode, both bypass lines 33 and 34 are then closed by means of the shut-off device 42 assigned to the mixing line 37, but coupling or connection of the first silencers 15 and 16 in both exhaust tracts 11 and 12 is achieved by means of the opened shut-off device 41. It is thereby possible to achieve an optimized torque profile of the internal combustion engine in a mid- to high rotational speed range and load range without increasing noise emissions by opening the bypass lines 33 and 34. Here too, it should once again be noted that the sections of the bypass lines 33 and 34 which open into the chambers 25, 26 of the first silencers 15, 16 can also be counted as part of the mixing line 37 since these sections participate both in the bypass function for the second silencers 19, 20 and in the connecting function for the first silencers 15, 16.

It is common to both embodiments that they are of simple construction. With a small amount of installation space, low weight and low costs, it is possible to optimize the noise behavior of exhaust systems and the efficiency of internal combustion engines to which such an exhaust system is assigned.

LIST OF REFERENCE SIGNS

10 Exhaust system
11 Exhaust tract
12 Exhaust tract
13 Arrow/exhaust gas
14 Arrow/exhaust gas
15 First silencer
16 First silencer
17 Inlet line
18 Inlet line
19 Second silencer
20 Second silencer
21 Outlet line
22 Outlet line
23 Arrow/exhaust gas
24 Arrow/exhaust gas
25 First chamber
26 First chamber
27 Second chamber
28 Second chamber
29 Dividing wall
30 Dividing wall
31 Section
32 Section
33 Bypass line
34 Bypass line
35 Arrow/exhaust gas
36 Arrow/exhaust gas
37 Mixing line
38 Shut-off device
39 Shut-off device
40 Exhaust system
41 Shut-off device
42 Shut-off device

The invention claimed is:

1. An exhaust system for an internal combustion engine comprising:

a first exhaust tract assigned to a first group of cylinders of the internal combustion engine;

a second exhaust tract assigned to a second group of cylinders of the internal combustion engine, wherein each exhaust tract comprises an exhaust gas purification device, a first silencer arranged on an outlet side of the respective exhaust gas purification device, and a second silencer arranged on the outlet side of the respective first silencer, wherein each exhaust tract comprises a bypass line for diverting gas starting from the respective first silencer, wherein the bypass lines and the first silencers of both exhaust tracts are connected to one another by a mixing line, wherein the bypass lines and the mixing line bypass the second silencers.

2. The exhaust system as claimed in claim 1, wherein the first silencer of each exhaust tract has at least two chambers, which are connected by perforated dividing walls.

3. The exhaust system as claimed in claim 1, wherein an inlet line of the respective first silencer extends between the exhaust gas purification device of the respective exhaust tract and the respective first silencer, wherein an outlet line of the respective first silencer extends between the respective first silencer and the respective second silencer of the respective exhaust tract, and wherein the bypass line of the respective exhaust tract branches off from the respective first silencer and opens with one end into the same chamber of the respective first silencer.

4. The exhaust system as claimed in claim 3, wherein sections of the inlet line of the first silencer and/or of the outlet line of the first silencer which extend within the respective first silencer are perforated.

5. The exhaust system as claimed in claim 4, wherein the perforated section of the inlet line and/or of the outlet line of the first silencer extends within a second chamber of the first silencer, which is connected to the first chamber by way of a perforated dividing wall.

6. The exhaust system as claimed in claim 1, wherein the bypass line of at least one exhaust tract is assigned a shut-off device, by means of which the respective bypass line can be opened and closed.

7. The exhaust system as claimed in claim 6, wherein the bypass line of each exhaust tract is assigned a respective shut-off device, by means of which the respective bypass line can be opened and closed.

8. The exhaust system as claimed in claim 7, wherein the bypass lines are opened and closed uniformly by the shut-off devices.

9. The exhaust system as claimed in claim 7, wherein the bypass lines are opened and closed non-uniformly by the shut-off devices.

10. The exhaust system as claimed in claim 6, wherein the bypass line of just one exhaust tract and the mixing line are each assigned a shut-off device, by means of which the bypass line and the mixing line can be opened and closed.

11. The exhaust system as claimed in claim 10, wherein the bypass line and the mixing line are opened or closed uniformly by the shut-off devices.

12. The exhaust system as claimed in claim 10, wherein the bypass line and the mixing line are opened or closed non-uniformly by the shut-off devices.

13. The exhaust system as claimed in claim 1, wherein the bypass line of each exhaust tract is routed through the respective first silencer at a location downstream of the mixing line, as seen in a direction of flow of the exhaust gas.

* * * * *